United States Patent [19]

Budzich

[11] 4,330,009

[45] * May 18, 1982

[54] EXHAUST PRESSURIZATION OF LOAD RESPONSIVE SYSTEM

[76] Inventor: Tadeusz Budzich, 80 Murwood Dr., Moreland Hills, Ohio 44022

[ * ] Notice: The portion of the term of this patent subsequent to Feb. 10, 1998, has been disclaimed.

[21] Appl. No.: 97,851

[22] Filed: Nov. 27, 1979

Related U.S. Application Data

[63] Continuation-in-part of Ser. No. 49,660, Jun. 18, 1979, Pat. No. 4,249,570, and Ser. No. 960,767, Nov. 15, 1978, Pat. No. 4,209,039.

[51] Int. Cl.[3] ..... F15B 13/08

[52] U.S. Cl. ..... 137/596.13; 60/428; 60/452; 60/468; 60/486; 91/436

[58] Field of Search ..... 91/436; 137/596.13; 60/428, 452, 468, 486

[56] References Cited

U.S. PATENT DOCUMENTS 4,107,923 8/1978 Budzich ..... 137/596.13 X
4,249,570 2/1981 Budzich ..... 137/596.13

*Primary Examiner*—Gerald A. Michalsky

[57] ABSTRACT

In a load responsive fluid power and control system employing plurality of control valves with positive and negative load compensation, a closed loop pressurized exhaust system supplied with a make-up and fluid exchange pump equipped with an unloading device responsive to positive and negative load system pressures.

10 Claims, 1 Drawing Figure

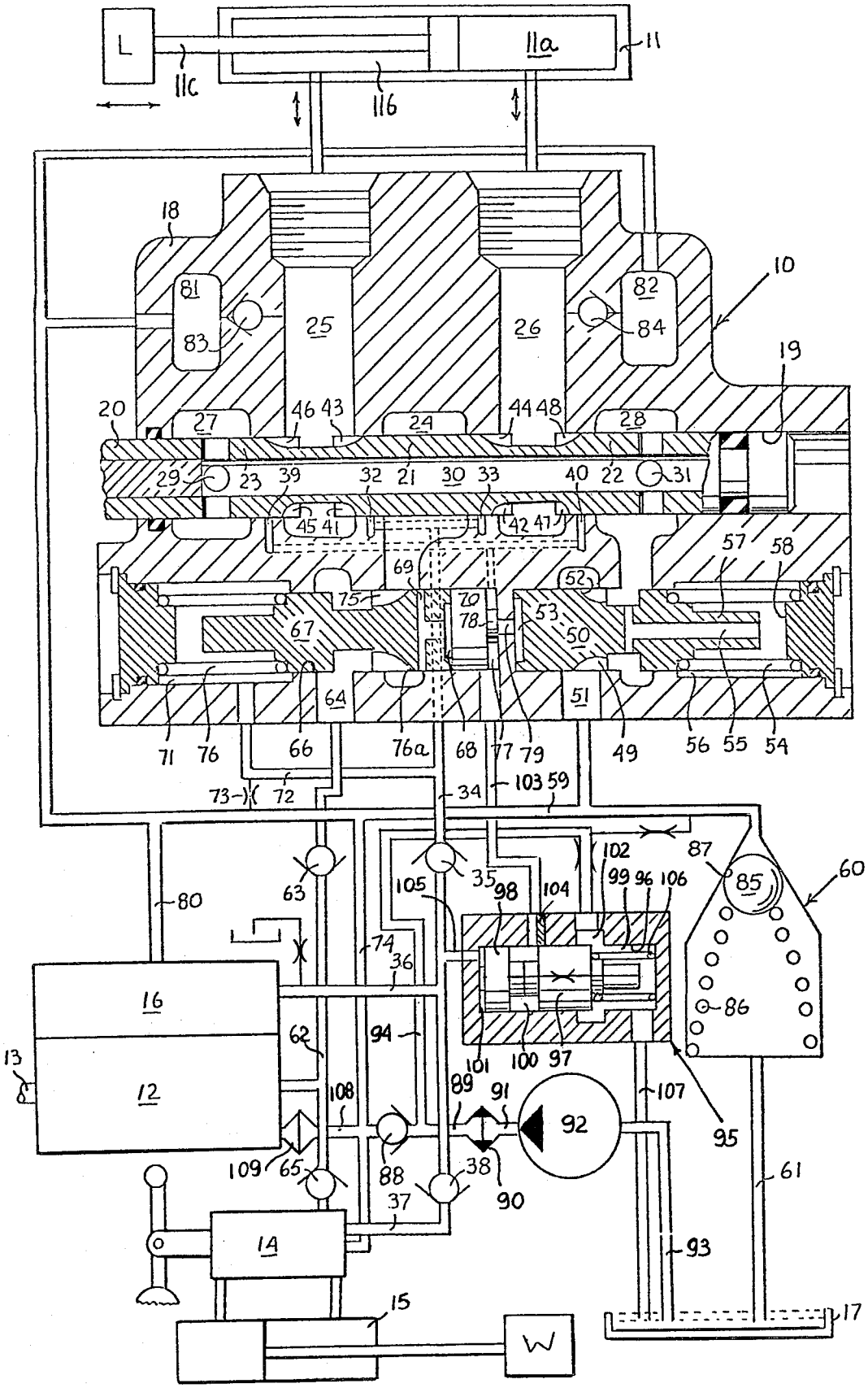
L
11a
11
11c
11b
18
81
83
25
26
82
84
10
19
20
27
46
43
24
44
48
28
29
23
39
32
21
30
33
40
22
31
45
41
42
47
57
58
69
52
75
70
78
53
50
67
64
51
71
76
66
76a
68
77
79
49
56
55
54
73
72
34
103
59
63
35
105
98
104
102
99
96
106
87
85
60
80
74
36
86
16
62
94
101
100
97
13
12
108
89
91
92
107
95
109
65
88
38
90
61
37
14
93
15
17
W

EXHAUST PRESSURIZATION OF LOAD RESPONSIVE SYSTEM

This application is a continuation in part of application Ser. No. 049,660, filed June 18, 1979, for "Exhaust Pressurization Of Load Responsive System," now U.S. Pat. No. 4,249,570, and Ser. No. 960,767, filed Nov. 15, 1978, for "Load Responsive Control Valve", now U.S. Pat. No. 4,209,039.

BACKGROUND OF THE INVENTION

This invention generally relates to a fluid power and control system, in which the exhaust flow of system motors is used directly to provide inlet flow requirement of the system pump.

In still more particular aspects this invention relates to pressurized exhaust system of a plurality of fluid motors, controlled by load responsive valves, the exhaust system supplied with a make-up and fluid exchange pump and used to supply the inlet flow requirements of the system pump.

In still more particular aspects this invention relates to a load responsive fluid power and control system in which the exhaust flow of system motors, supplemented by fluid flow from a make-up and fluid exchange pump, equipped with load responsive unloading and bypass device, is used to supply pressurized inlet flow requirement of the system pump.

Pressurization of the exhaust flow from compensated load responsive valves and also pressurization of system pump inlet is very desirable, but it suffers from the disadvantage of comparatively large throttling losses, directly affecting system efficiency and from the necessity of providing full flow inlet pressurizing pump which is expensive. Closed loop systems, involving a pump and a rotary type fluid motor are well known in the art. Such closed loop systems are characterized by their pressure flow being approximately equal to their exhaust flow. A small exhaust feeding or make-up pump is usually provided to pressurize the exhaust loop and to provide a measure of fluid exchange, in order to cool the closed loop system. Such a make-up pump supplies full flow of pressurized fluid in system standby condition and is not intended for systems, in which comparatively large differences between pump outlet flow and system return flow can take place, which is the case in systems using cylinders as fluid motors. Full flow inlet pressurization has been used in the past, but as previously mentioned it is expensive, since it requires not only a full flow low pressure make-up pump, but also separate drive, large fluid lines, fittings etc.

SUMMARY OF THE INVENTION

It is therefore a principal object of this invention to reduce total pump output by blocking off its flow during control of negative loads, reduce exhaust fluid flow fluctuations, use the system exhaust flow to supply the inlet flow requirement of the system pump and to supplement, pressurize and partially exchange for system cooling purposes, the exhaust system flow by a separate low pressure make-up and fluid exchange pump.

It is a further object of this invention to close the loop of a central load responsive system using plurality of rotary and reciprocating fluid motors, to provide both the necessary pressurization of the exhaust of the compensated load responsive valves and to provide a pressurized inlet flow of the system pump, with minimum power loss and with use of small make-up pump for exhaust pressurization and flow exchange.

It is a further object of this invention to unload the make-up pump with the load responsive system in its standby condition, and during control of negative load from the piston end of the cylinder, to further minimize the system loss.

Briefly the foregoing and other objects of this invention are accomplished by pressurizing the exhaust circuit of the load responsive system valves without throttling process, while simultaneously providing the advantage of inlet pressurization of system pump. The comparatively small make-up pump, provided for pressurization and cooling of the exhaust loop, is automatically unloaded with the system in its standby condition. The load responsive pressure compensated system valves do not use pump flow during control of negative loads, further reducing the size of the make-up pump and the amount of cooling exchange flow necessary to cool the system.

Additional objects of this invention will become apparent when referring to the preferred embodiment of the invention as shown in the accompanying drawing and described in the following detailed description.

DESCRIPTION OF THE DRAWING

The drawing shows a sectional view of an embodiment of a flow control valve having positive and negative load compensation and exhaust system unloading valve with lines, system flow control, system pump, second load responsive valve, exhaust relief valve, inlet charging pump and system reservoir shown diagramatically.

DESCRIPTION OF THE PREFERRED EMBODIMENT

Referring now to the drawing, an embodiment of a flow control valve, generally designated as 10, is shown interposed between diagramatically shown fluid motor having chambers 11*a* and 11*b* and piston rod 11*c*, connected to a load L and a pump 12 of a fixed displacement or variable displacement type driven through a shaft 13 by a prime mover not shown.

Similarly, a flow control valve 14, identical to flow control valve 10, is interposed between a diagramatically shown fluid motor 15 driving a load W and the pump 12. Fluid flow from the pump 12 to flow control valves 10 and 14 is regulated by a pump flow control 16. If pump 12 is of a fixed displacement type, pump flow control 16 is a differential pressure relief valve, which, in a well known manner, by bypassing fluid from the pump 12 into the exhaust circuit, maintains discharge pressure of pump 12 at a level, higher by a constant pressure differential, than load pressure developed in fluid motor 11 or 15. If pump 12 is of a variable displacement type pump flow control 16 is a differential pressure compensator, well known in the art, which by changing displacement of pump 12 maintains discharge pressure of pump 12 at a level, higher by a constant pressure differential, than load pressure developed in fluid motor 11 or 15.

The flow control valve 10 is a fourway type and has a housing 18 provided with a bore 19 axially guiding a valve spool 20. The valve spool 20 is equipped with lands 21, 22, 23 which in neutral position of the valve spool 20, as shown in the drawing, isolate a fluid supply chamber 24, load chambers 25 and 26 and outlet chambers 27 and 28. The outlet chamber 27 is connected through ports 29, central passage 30 in valve spool 20 and ports 31 to the outlet chamber 28.

Positive load sensing ports 32 and 33, located between load chambers 25 and 26 and the supply chamber 24 and blocked in neutral position of valve spool 20 by land 21, are connected through signal passage 34, a check valve 35 and signal line 36 to pump flow control 16. In a similar manner positive load sensing ports of flow control valve 14 are connected through line 37, a check valve 38 and signal line 36 to the pump flow control 16. Negative load sensing port 39 is located between load chamber 25 and outlet chamber 27. Similarly, negative load sensing port 40 is located between load chamber 26 and outlet chamber 28.

The land 21 of the valve spool 20 is equipped with signal slots 41 and 42, located in plane of positive load sensing ports 32 and 33 and metering slots 43 and 44, which, in a well known manner, can be circumferentially spaced in respect to each other and in respect to the signal slots 41 and 42. The land 23 is equipped with signal slot 45, located in plane of negative load sensing port 39 and circumferentially spaced metering slot 46. The land 22 is equipped with signal slot 47, located in plane of negative load sensing port 40 and circumferentially spaced metering slot 48. Signal slots 41, 42, 45 and 47, in a well known manner, can be substituted by end surfaces of lands 21, 22 and 23. A suitable device is provided to prevent relative rotation of the spool 20 in respect to bore 19.

The outlet chamber 28 is connected through slots 49, of a negative load control spool 50, to an exhaust chamber 51. The negative load control spool 50 having slots 49, provided with throttling edges 52, projects into control space 53 and is biased towards position, as shown, by spring 54. The negative load control spool 50 is provided with passage 55 connecting the outlet chamber 28 with space 56 and is equipped with stop 57, limiting its displacement against surface 58. The exhaust chamber 51 in turn is connected to exhaust line 59. An exhaust relief valve, generally designated as 60, communicates exhaust line 59 through line 60 to the reservoir 17.

The pump 12 through its discharge line 62 and load check 63, is connected to a fluid inlet chamber 64. Similarly, discharge line 62 is connected through load check valve 65 with the inlet chamber of the fluid control valve 14. The control bore 66 connects the fluid inlet chamber 64 with the fluid supply chamber 24. The control spool 67, axially slidable in control bore 66, projects on one end into space 68, connected to the fluid supply chamber 24 by passage 69 and abuts against a free floating piston 70. The control spool 67 on the other end projects into control space 71, which is connected by passage 72 with positive load sensing ports 32 and 33 and through leakage orifice 73 to exhaust line 59 and to upstream of exhaust relief valve 60. Similarly, control space and leakage orifice of the control valve 14 is connected by line 74 to upstream pressure of exhaust relief valve 60. The control spool 67 is provided with slots 75 terminating in throttling edges 76*a*, positioned between the inlet chamber 64 and the supply chamber 24. The control spool 67 is biased by a control spring 76 towards position, in which slots 75 connect the fluid supply chamber 24 with the fluid inlet chamber 64.

The free floating piston 70 on one end is subjected to pressure in space 68, which is connected to the fluid supply chamber 24 and on the other end is subjected to pressure in control space 77, which is connected to negative load pressure sensing ports 39 and 40. Projection 78 of the free floating piston 70, in the position as shown, effectively seals port 79 and control space 53 from control space 77.

The exhaust relief valve, generally designated as 60, is interposed between combined exhaust circuits of flow control valves 10 and 14, including bypass circuit of pump 12 and reservoir 17. The pressurized exhaust circuit of flow control valve 10 includes exhaust line 59 connected to bypass line 80 and connected to chambers 81 and 82, which are operationally connected for one way fluid flow by check valves 83 and 84 with load chambers 25 and 26. The exhaust relief valve 60 is provided with a throttling member 85, biased by a spring 86 towards engagement with seat 87.

A check valve 88 is located between line 74, connected to the combined exhaust circuits of flow control valves 10 and 14 and an exhaust make-up circuit, composed of line 89, a heat exchanger 90, line 91 and make-up pump 92, which is connected by line 93 with the reservoir 17. Line 89 is connected by line 94 to an exhaust unloading valve, generally designated as 95. The exhaust unloading valve 95 is provided with bore 96, slidably guiding a spool 97 and a piston 98, which functionally divide bore 96 into spaces 99, 100 and 101. Bore 96 is provided with annular space 102, connected through line 94 with the make-up pump 92. Space 100 is connected by line 103 with control space 77, which communicates directly with negative load sensing ports 39 and 40 or is plugged by a plug 104. Space 101, through line 105, is connected to signal line 36. The spool 97 and the piston 98 are biased by a spring 106 towards position, as shown in the drawing, maintaining communication between annular space 102 and space 99, which is connected by line 107 with system reservoir 17. The make-up pump 92 is connected through line 91, the heat exchanger 90, line 89, the check valve 88, line 108 and schematically shown filter 109 with inlet of the pump 12. Line 89, between the check valve 88 and the filter 109, is connected to line 74 and therefore to the exhaust circuits of the flow control valves 10 and 14.

If the pump 12 is of a fixed displacement type excess pump flow from the differential pressure relief valve or pump flow control 16 is delivered through line 80 to the exhaust line 59 and therefore to the total pressurized exhaust circuit of flow control valves 10 and 14.

The sequencing of the lands and slots of valve spool 20 preferably is such that when displaced in either direction from its neutral position, as shown in FIG. 1, one of the load chambers 25 or 26 is first connected by signal slots 41 or 42 to the positive load sensing port 32 or 33, while the other load chamber is connected by signal slots 45 or 47 to the negative load sensing port 39 or 40, while the load chambers 25 and 26 are still isolated from the supply chamber 24 and the outlet chambers 27 and 28. Further displacement of the valve spool 20 from its neutral position connects load chamber 25 or 26 to the supply chamber 24 through metering slots 43 or 44, while connecting the other load chamber through metering slots 46 or 48 with one of the outlet chambers 27 or 28.

Referring now to the drawing, with the pump 12 of a fixed displacement type started up, the pump flow control 16 will bypass all of the pump flow through line 80 to exhaust line 59. From exhaust line 59 the flow will be supplied to inlet of the pump 12 through line 108 and the filter 109. This flow will be supplemented by the flow delivered from the make-up pump 92 through the heat exchanger 90, line 89 and check valve 88. The pump 12 will automatically maintain pressure in discharge line 62 at a constant pressure, higher by a constant pressure differential, than pressure in signal line 36 or pressure in exhaust line 59. The pressure in exhaust line 59, due to internal leakage of the pump 12, will be dictated by the discharge pressure of the make-up pump 92, discharge port of which is connected through line 94, annular space 102, space 99 and line 107 to the system reservoir 17 and therefore is maintained at a low pressure level. When using a fixed displacement pump 12, for circuit cooling purposes, exhaust line 59, in a well known manner, may be connected by a suitable leakage orifice with line 94, as shown in the drawing. Therefore all of the pump flow is diverted by the pump flow control 16 to the low pressure exhaust circuit, as previously described, without being used by flow control valves 10 and 14. Since signal line 36 is connected by passage 72 with control space 71, which is also connected through leakage orifice 73 to exhaust line 59, the bypass pressure in the discharge line 62 will be higher, by a constant pressure differential, than the pressure in exhaust line 59. This pump bypass pressure transmitted through passage 69 to space 68 reacts on the cross-sectional area of control spool 67 and against the bias of control spring 76 moves the control spool 67 from right to left, closing with throttling edges 76*a* the passage between the inlet chamber 64 and the supply chamber 24.

With the pump 12 of a variable displacement type started up and with discharge line 62 blocked by valve spool 20, in a well known manner, the pressure in the discharge line 62 will rise to a certain minimum pressure level, at which the differential pressure compensator 16 will move the displacement changing mechanism of the variable displacement pump 12 to a zero flow position and maintain the discharge line 62 at this minimum pressure level. Therefore only suction fluid, due to the internal leakage of the pump 12, has to be delivered to inlet of the pump 12 and most of the flow will be delivered by the make-up pump 92 through line 91, the heat exchanger 90, lines 89 and 94, annular space 102, space 99 and line 107 to the reservoir 17, at a minimum pressure level.

Assume that the load chamber 25 is subjected to a positive load. The initial displacement of the valve spool 20 to the right will connect the load chamber 25 through signal slot 41 with positive load sensing port 32, white lands 21, 22 and 23 still isolate the supply chamber 24, load chambers 25 and 26 and outlet chambers 27 and 28. As previously described positive load signal transmitted from positive load sensing port 32, through signal passage 34, check valve system and signal line 36 to the pump flow control 16 will increase the pressure in discharge line 62 to a level, which is higher by a constant pressure differential than the load pressure signal. The load pressure, transmitted through passage 72 to control space 71, will move the positive load control spool 67 to the right, opening through slots 75 communication between the inlet chamber 64 and the supply chamber 24. Communication will be maintained between the supply chamber 24 and the inlet chamber 64, as long as the pump flow control 16 maintains a constant pressure differential between the pump discharge pressure and the positive load pressure. Positive load pressure signal from signal line 36 will also be transmitted through line 105 to space 101 where, reacting on the cross-sectional area of the piston 98, will move it together with the spool 97, against the biasing force of spring 106, all the way to the right, cutting off communication between annular space 102 and space 99. The fluid flow, delivered from the make-up pump 92, will raise the pressure in the total exhaust system to the level, equivalent to pressure setting of the exhaust relief valve 60 and will pass through it to the system reservoir 17. Therefore with the positive load sensing circuit of either of the flow control valves activated and the signal line 36 subjected to a pressure level, higher than that, equivalent to preload in the spring 106, the exhaust unloading valve 95 will automatically isolate the fluid flow delivered by the make-up pump 92 from the reservoir 17, thus diverting all of the flow from the exhaust circuit through exhaust relief valve 60, automatically raising the pressure level of the exhaust circuit to that equivalent to the pressure setting of the exhaust relief valve 60. The differential pressure compensator 16, as is well known in the art, is always provided with leakage path to the reservoir 17. For purposes of demonstration such a leakage path is shown diagramatically from signal line 36. With positive load pressure signals from system valves no longer being transmitted, the pressure in the signal line 36 will drop to pressure of reservoir 17 and under action of the biasing spring 106 the spool 97 and the piston 98 will be moved all the way to the left, connecting exhaust circuit, through annular space 102, with system reservoir. Under those conditions, with the exhaust circuit maintained at a minimum pressure level, exhaust flow from the make-up pump 101 will be bypassed to system reservoir 17 at a minimum pressure level.

Further displacement of the valve spool 20 to the right will connect the load chamber 25, through metering slot 43, with the supply chamber 24 and will also connect through metering slot 48 the load chamber 26 with the outlet chamber 28. In a manner as previously described, the pump flow control 16 will maintain a constant pressure differential across orifice, created by displacement of metering slot 43, the flow into the load chamber 25 and chamber 11*b* of the fluid motor 11 being proportional to the area of the orifice and therefore displacement of the valve spool 20 from its neutral position and independent of the magnitude of the load L. Proportional fluid flow, larger by displacement of piston rod 11*c*, will be delivered from the chamber 11*a* and transferred through the load chamber 26, metering slot 48, outlet chamber 28, slots 49 and the exhaust chamber 51 to the exhaust circuit. Since the outlet flow from the fluid motor 11 is larger than the inlet flow requirement of the pump 12, the flow of fluid, passed through the relief valve 60 and equivalent to flow delivered by make-up pump 92, will be increased by flow equivalent to displacement of the piston rod 11*c*. With the pump flow at a controlled level delivered to the load chamber 26 and the chamber 11*a*, proportional flow, smaller by displacement of the piston rod 11*c*, will be delivered from the chamber 11*b* to the exhaust system. Therefore the inlet flow into the fluid motor 11 is larger than its outlet flow, which must be supplemented by the flow from the make-up pump 92, to maintain inlet of the pump 12, to maintain inlet of the pump 12 pressurized. Therefore flow of fluid through the exhaust relief valve 60 will be reduced and equal to the difference between the flow delivered into the exhaust circuit by the make-up pump 92 and the flow, equivalent to displacement of the piston rod 11*c*. During control of positive load the free floating piston 70 is subjected to pressure in the supply chamber 24 and through negative load sensing port 40 to the low pressure in the load chamber 26. This pressure differential maintains the free floating piston 70 to the right closing with projection 78 and port 79 communication between control spaces 77 and 53, effectively deactivating the negative load control spool 50.

Assume that while controlling positive load L through the flow control valve 10, a higher positive load W is actuated through the flow control valve 14. Higher load pressure signal from the flow control valve 14 will be transmitted through the check valve system to the pump flow control 16, which will now maintain system pressure, higher by a constant pressure differential, than pressure generated by positive load W. In a manner as previously described, the pressure drop through metering slot 43 will increase, therefore increasing the pressure differential between space 68 and control space 71. The positive load control spool 67 will move into its modulating position, throttling with throttling edges 76*a* the fluid flowing from the inlet chamber 64 to the supply chamber 24, to maintain a constant pressure differential between the supply chamber 24 and the load chamber 25, thus controlling fluid flow through metering slot 43. While this throttling control action takes place, control space 77 is connected through the negative load pressure sensing port 40 with low pressure existing in the load chamber 26. The same low negative load pressure signal will be transmitted through line 103 to space 100, where it will not affect the operation of the exhaust unloading valve 95. Free floating piston 70, subjected to pressure in the supply chamber 24 is maintained to the right and closes with projection 78 port 79, leading to control space 53. In this way negative load control spool 50 becomes isolated from the negative load pressure signal and the negative load control spool 50 must remain inactive during control of positive load. This action of the free floating piston 70 provides an effective interlock between positive and negative load controllers.

Assume that the load chamber 26 is subjected to a negative load L and that the valve spool 20 is displaced from its neutral position to the right while, as previously described, the positive load control spool 67 is maintained by the pump standby pressure in a position blocking communication between the inlet chamber 64 and the supply chamber 24. Initial displacement of the valve spool 20 will connect through signal slot 41 the load chamber 25 with the positive load sensing port 32. Since the load chamber 25 is subjected to low pressure neither the pump flow control 16 nor the positive load control spool 67 nor the exhaust unloading valve 95 will react to it. Simultaneously signal slot 47 will be connected to the negative load sensing port 40, connecting the load chamber 26, subjected to negative load pressure through signal passages with control space 77. Since the control spool 67, biased by control spring 76, is contacting the free floating piston 70, the pressure differential, developed between control space 71 and control space 77 will move the free floating piston 70 and the control spool 67 to the left, opening with projection 78 port 79, cross-connecting control space 77 with control space 53. Under action of negative load pressure, supplied from the negative load pressure sensing port 40, the free floating piston 70 will move control spool 67 all the way to the left, isolating with throttling edges 76*a* the supply chamber 24 from the inlet chamber 64. At the same time negative load pressure from control space 77, transmitted through port 79 to control space 53, reacting on the cross-sectional area of negative load control spool 50 will move it, against the biasing force of spring 54, all the way to the right, with throttling edges 52 cutting off communication between the outlet chamber 28 and the exhaust chamber 51. The negative load pressure from control space 77 will also be transmitted through line 103 to space 100 where, reacting on the cross-sectional area of spool 97, will move it all the way to the right, against biasing force of spring 106, cutting off direct communication between the discharge line of the make-up pump 92 and the reservoir 17. Due to the pressure differential between spaces 100 and 101 the piston 98 will be maintained in the position as shown in the drawing. Therefore in the presence of either positive or negative load pressure signals, higher than that equivalent to preload in the spring 106, the exhaust unloading valve 95 will automatically isolate the outlet of the make-up pump 92 from direct communication with the reservoir 17, raising the pressure of the exhaust circuit to that, equivalent to the pressure setting of the exhaust relief valve 60. Space 100 can be connected through a suitable leakage orifice in the spool 97 communicating with space 93. Such an orifice, well known in the art, is diagrammatically shown on the drawing and would act in a similar way as clearance between the spool 97 and bore 96. Then in the absence of the negative load pressure signal the spool 97, biased by spring 106, would move from right to left, to the position as shown in the drawing, providing a direct passage between the outlet of the make-up pump 92 and the reservoir.

Further displacement of valve spool 20 to the right will connect through metering slot 48 the load chamber 26 and the chamber 11*a* with the outlet chamber 28, while also connecting through metering slots 43 the load chamber 25 with the supply chamber 24. Since the outlet chamber 28 is isolated by position of the negative load control spool 50, the pressure in the outlet chamber 28 will begin to rise, until it will reach a level, at which force generated on the cross-sectional area of the negative load control spool 50, by the pressure in control space 53, will equal the sum of the force generated on the same cross-sectional area by the pressure in the outlet chamber 28 and therefore pressure in space 56 and the biasing force of the spring 54. At this point the negative load control spool 50 will move from right to left, into a modulating position, in which fluid flow from the outlet chamber 28 to the exhaust chamber 51 will be throttled by the throttling edges 52, to automatically maintain a constant pressure differential, equivalent to biasing force of the spring 54, between the load chamber 26 and the outlet chamber 28. Since during control of negative load a constant pressure differential is maintained across the orifice, created by the displacement of metering slot 48, by the throttling action of negative load control spool 50, fluid flow through metering slot 48 will be proportional to the displacement of the valve spool 20 and constant for each specific position of metering slot 48, irrespective of the change in the magnitude of the negative load L.

As previously described during control of negative load the control spool 67 will be maintained by the free floating piston 70 in a position, where it isolates the inlet chamber 64 from the supply chamber 24. The inlet flow requirement of load chambers 25 and 26 and chambers 11*a* and 11*b* is supplied through check valves 83 and 84 from the outlet flow from one of the load chambers and total system exhaust flow available from the exhaust manifold, pressurized by the exhaust relief valve 60. The pressure setting of the exhaust relief valve 60 is high enough to provide the necessary pressure drop through check valve 83, at the highest rates of flow from the exhaust manifold to the load chamber 25, without pressure in the load chamber 25 dropping below atmospheric level, thus preventing any possibility of cavitation. In this way, during control of negative load, inlet flow requirement of the actuator is not supplied from the pump circuit but from the pressurized exhaust circuit of flow control valves 10 and 14 and from the make-up pump 92, conserving the pump flow and increasing system efficiency. If negative load pressure is not sufficiently high to provide constant pressure drop through metering slot 48, the negative load control spool 50 will move to the left from its modulating and throttling position, the negative load pressure in the load chamber 26 and control space 77 will drop to a level at which the pressure in space 68, due to the setting of the exhaust relief valve 60, with the biasing force of control spring 76 will move the free floating piston 70 to the right together with the control spool 67 with projection 78 closing port 88. The check valve 83 will close and the control system will revert to its positive load mode of operation, providing the energy to load L from the pump circuit to maintain a constant pressure differential across metering slot 43, which will also maintain a constant pressure differential across metering slot 32. During control of negative load the inlet flow requirement of the actuator is supplied from the outlet flow from the actuator, bypass flow from pump flow control, flow from the make-up pump 92 and the exhaust circuits of all of the other system flow control valves through check valves 83 and 84. With discharge line 62 blocked and with the pump 12 being of fixed displacement type, the full pump flow is diverted at minimum pressure level by differential pressure bypass valve 16, through line 80 into the exhaust circuit. When controlling a negative load from the chamber 11*a*, the inlet flow requirement of the chamber 11*b*, of fluid motor 11, is less than outlet flow delivered from the chamber 11*a*. Therefore an excess flow, equivalent to displacement of the piston rod 11*c*, is passed into the exhaust circuit. Since the total inlet flow requirement of the pump 12 is supplied from its own bypass circuit, the total flow of the make-up pump 92 plus the flow, equivalent to the displacement of the piston rod 11*c*, will be passed through exhaust relief valve 60. If the negative load is unidirectional and if it takes place in chamber 11*a* signal line 103 can be blocked by plug 104. Then, during control of negative load, the make-up pump 92 can be completely unloaded, by absence of the positive load signal and the inlet flow requirements of the pump 12 will be supplied directly from the chamber 11*a*, the exhaust relief valve 60 pressurizing the exhaust circuit and passing the volume of fluid within the displacement of the piston rod 11*c*. While the make-up pump 92 is unloaded the pressurized circuit is isolated from the outlet of the make-up pump 92 by the check valve 88. In this way, with the make-up pump 92 unloaded, during control of negative load the heat input into the working fluid is reduced and the system efficiency increased.

When controlling a negative load from the chamber 11*b* outlet flow of the fluid motor 11 is smaller than its inlet flow requirement into the chamber 11*a*. The difference between this inlet and outlet flow, equal to the flow, equivalent to the displacement of the piston rod 11*c*, is supplied into the chamber 11*a* from the make-up pump 92. Under those conditions the flow passing through the exhaust relief valve 60 is equal to the difference between output flow of the make-up pump 92 and the flow, equivalent to the displacement of piston rod 11*c*. The higher the speed of the load L the higher the flow required by displacement of the piston rod 11*c*. Therefore, when controlling a negative load from the chamber 11*b*, the maximum speed of the motor 11 is limited by the flow capability of the make-up pump 92. When controlling a negative load from the chamber 11*a*, since the outlet flow exceeds the inlet flow requirement of the motor 11, the exhaust circuit can be maintained pressurized at all speeds of load L, even without the presence of the make-up pump 92.

During control of negative load, with valve spool 20 displaced to the left, the metering slot 46 throttles the oil flow to outlet chamber 27 and this flow is supplied through ports 29, central passage 30 in valve spool 20 and ports 31 to the outlet chamber 28. Therefore ports 29, central passage 20 and ports 31 cross-connect outlet chambers 27 and 28 permitting bidirectional control of negative load.

The embodiment of flow control valve 10 is such that it provides a load responsive valve with positive load metering orifices between the supply chamber and the load chambers and negative load metering orifices between the load chambers and the outlet chambers. Therefore the positive load control responds to socalled upstream pressure differential, well known in the art. There are other types of load responsive valves, which in control of positive load, respond to down stream pressure differential or down stream pressure. Such load responsive controls are disclosed in applicant's U.S. Pat. Nos. 3,984,979 of Oct. 12, 1976, 3,998,134 of Dec. 21, 1976 and 4,099,379 of July 11, 1978. In those load responsive controls no throttling action is present between the supply chamber and the load chambers and therefore the positive load sensing ports are directly subjected to the pressure of the supply chamber, with the valve spool moved from its neutral position. Since load chambers of all of those valves are always maintained at a certain minimum pressure level, this pressure can be used to actuate the exhaust unloading valve 95, during control of negative load. Therefore with those load responsive valves the negative load pressure input through line 103 to space 100 is not necessary and the exhaust unloading valve 95 will be activated just by the signal from the positive load sensing ports, during control of positive and negative loads, once the valve spool is moved in either direction from its neutral position.

During control of negative load, with the pump 12 being of a variable displacement type, due to the blocked outlet the pump is maintained in zero displacement position, with zero inlet flow requirement. When controlling a negative load from the chamber 11*a*, in a manner as previously described, excess flow is generated into the exhaust circuit. If the negative load is unidirectional and if it is generated in the chamber 11*a*, the plug 104 can be used and as previously stated the make-up pump 92 can remain unloaded during control of negative load, the check valve 88 isolating the pressurized exhaust circuit from the make-up pump 92. When controlling the negative load from chamber 11*b* the flow, equivalent to the displacement of the piston rod 11*c*, must be supplied into the fluid motor 11 from the exhaust circuit, this flow being supplied by the make-up pump 92. Since the inlet flow requirement, due to displacement of the piston rod 11*c*, is proportional to speed of the load L, it is therefore limited by the maximum flow capacity of the make-up pump 92.

With flow control valves 10 and 15 controlling loads L and W, during control of negative loads, in a manner as previously described, the pump flow is not used to supply the inlet flow requirement of the fluid motors, but is completely blocked from the fluid motors, the motor outlet flow supplying its own inlet flow requirement. Under those conditions the make-up pump 92 is not necessary to supply the inlet pressurization of the system pump, but to supply directly, if required, the make-up flow into the system motors. In the load responsive system of the present invention the make-up pump 92 performs the dual function of providing the necessary pressurization of the system pump inlet and of providing the necessary pressure for flow exchange between ports of the fluid motors, during control of negative loads. Since the system pump supplies the energy into the system, proportional to pressure differential existing across its ports, the energy of the pressurized exhaust fluid, from the system motors, is recovered thus improving the system efficiency.

The flow control valve 10, with its free floating piston 70 blocked, will perform in a different way. During control of negative load from the chamber 11*b*, or when controlling a positive load using the chamber 11*a* the flow, equivalent to the displacement of the piston rod 11*c* must be supplied into inlet port of pump 12 from the make-up pump 92. When controlling a positive load and connecting the pump 12 to the chamber 11*b*, the outlet flow from the chamber 11*a* exceeds the inlet flow requirement of the pump by flow, equivalent to the displacement of the piston rod 11*c*. Under these conditions the make-up pump 92 could be unloaded and the system efficiency increased. This can be done by providing an additional positive load sensing port 33 and connecting it either directly, or through a separate check valve logic system to space 101, while the line 105 is blocked. Under those conditions, during control of positive load, the make-up pump 92 would be unloaded when connecting the system pump with the chamber 11*b* and would be automatically activated when supplying the fluid flow into the chamber 11*a*. In this way the system efficiency can be further improved. The same approach can be taken, while controlling a negative load. By providing an additional negative load sensing port 39 and connecting it directly to space 100, only during the presence of negative load in the chamber 11*b* would the exhaust unloading valve 95 be activated and the make-up pump 92 would supply fluid flow into the exhaust circuit. When controlling negative load from the chamber 11*a* the make-up pump 92 would be completely unloaded, increasing system efficiency.

The exhaust unloading valve 95 is made responsive to both positive and negative load pressure signals and permits pressurization of the exhaust circuit, when either positive or negative loads are being controlled, providing the pressurized inlet flow either to the system pump or directly to the system motors. With the positive and negative load pressure signal dropping below a certain minimum predetermined level, signifying that the system valves are in neutral and the system pump is in a standby condition, the outlet of the make-up pump 92 is automatically connected by the exhaust unloading valve 95 directly to system reservoir 17. Under those conditions the make-up pump 92 is completely unloaded, greatly reducing the system loss in standby condition. The exhaust system is automatically unloaded only under the conditions, where, for example, a variable displacement pump is in its zero displacement position, not requiring pressurization of its inlet, or during control of unidirectional negative load from chamber 11*a* and negative load pressure signal blocked by the plug 104.

The exhaust unloading valve 95, with its spool 97 and piston 98, is directly operated by the energy derived from the negative and positive load sensing circuits. To minimize the use of this energy, in a well known manner, the spool 97 and piston 98 may be operated by a pilot valve, responsive to the positive and negative load pressure signals, but using energy from an external pressure source. In this way a minimal amount of energy from the load sensing circuits can be used in actuation of the flow controlling elements of the exhaust unloading valve 95.

The exhaust unloading valve 95, actuated by the load pressure signals, can also be used to perform another function. With system pump 12 being of a fixed displacement type and pump control 16 being a differential pressure relief valve, the annular space 102 can be directly connected to discharge line 62. Under those conditions the exhaust unloading valve 95 will act as an unloading valve of the differential bypass valve 16, ensuring that with valve spool in neutral position and load pressure signals at minimum level, the total pressure circuit of the pump is fully unloaded, with discharge line of the pump being directly connected by exhaust unloading valve 95 to the system reservoir 17.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly supplied with pressure fluid by a pump having inlet port means and outlet port means, said valve assembly comprising a housing having a fluid inlet chamber connected to said outlet port means, at least one load chamber, and exhaust means connected to reservoir means, first valve means for selectively interconnecting said load chamber with said inlet chamber and said exhaust means, signal port means in said housing selectively communicable with a source of pressure by said first valve means, charging pump means having discharge port means connected to said inlet port means of said pump and suction port means connected to said reservoir means, check valve means interposed between said inlet port means and said discharge port means and operable to connect for one way fluid flow said charging pump means and said inlet port means and second valve means interposed between said discharge port means and said reservoir means upstream of said check valve means having means responsive to pressure in said signal port means and means to unload said charging pump means.

2. A valve assembly as set forth in claim 1 wherein said exhaust means has fluid connecting means to said inlet port means of said pump.

3. A valve assembly as set forth in claim 2 wherein said exhaust means has exhaust relief valve means.

4. A valve assembly as set forth in claim 1 wherein said inlet port means of said pump has exhaust relief valve means connected to said reservoir means.

5. A valve assembly as set forth in claim 1 wherein said first valve means has means operable to selectively communicate said signal port means and said load chamber.

6. A valve assembly as set forth in claim 1 wherein said first valve means has means operable to selectively communicate said signal port means and said inlet chamber.

7. A valve assembly as set forth in claim 1 wherein said means responsive to pressure in said signal port means has disconnecting means operable to disconnect said charging pump means of said pump from said reservoir means when pressure in said signal port means exceeds a certain predetermined level.

8. A valve assembly as set forth in claim 1 wherein said means responsive to pressure in said signal port means has connecting means operable to connect said charging pump means to said reservoir means when pressure in said signal port means drops below a certain predetermined level.

9. A valve assembly as set forth in claim 1 wherein said signal port means includes positive load pressure port means communicable with an output flow control of said pump and with said means to unload said charging pump means.

10. A valve assembly as set forth in claim 1 wherein said signal port means includes negative load pressure port means communicable with said means to unload said charging pump means.

* * * * *